US005078123A

United States Patent [19]

Nagashima et al.

[11] Patent Number: 5,078,123

[45] Date of Patent: Jan. 7, 1992

[54] ELECTRIC WATER WARMING SYSTEM

[75] Inventors: Seiko Nagashima, Tone; Takanobu Serizawa, Susono, both of Japan

[73] Assignee: Kabushiki Kaisha Toshiba, Kawasaki, Japan

[21] Appl. No.: 151,524

[22] Filed: Dec. 18, 1989

[30] Foreign Application Priority Data

Feb. 15, 1989 [JP] Japan ..... 1-33710

[51] Int. Cl.[5] ..... A47J 27/00

[52] U.S. Cl. ..... 126/374; 392/454

[58] Field of Search ..... 237/8 R, 19; 126/422, 126/362, 374; 219/310, 316, 320, 330; 392/497, 498, 500, 501, 447, 451, 454, 455, 441

[56] References Cited

U.S. PATENT DOCUMENTS 4,182,489 1/1980 Lessieur ..... 237/8 R

FOREIGN PATENT DOCUMENTS 60-180954 1/1985 Japan .

*Primary Examiner*—Henry A. Bennet

*Attorney, Agent, or Firm*—Oblon, Spivak, McClelland, Maier & Neustadt

[57] ABSTRACT

An electric water warming system comprises a water storage tank of substantially cylindrical to be installed in a vertical fashion, a water feed pipe connected to a bottom portion of the water storage tank for feeding water thereinto, a hot water flow-out pipe connected to a top portion of the water storage tank for flowing out hot water therefrom, and a heating means disposed in the water storage tank at a portion relatively near the bottom portion of the water storage tank. The temperature of the hot water in the water storage tank is controlled by a control means including a hot water temperature sensor. A by-pass pipe is further connected to a side wall of the water storage tank at a portion relatively near the top portion of the water storage tank, and a three-way valve is assembled at a portion at which the by-pass pipe and the flow-out pipe are joined. The three-way valve acts so as to select the by-pass pipe and the flow-out pipe in accordance with a state of the hot water in usage thereof so that the late-night power as well as the daytime power can be effectively utilized.

1 Claim, 3 Drawing Sheets

ELECTRIC WATER WARMING SYSTEM

BACKGROUND OF THE INVENTION

The present invention relates to an electric water warming system capable of feeding hot water from a hot water storage tank and is particularly concerned with an electric water warmer for which the hot water storage tank is effectively prevented from being emptied.

An electric water warmer of this kind operates such that water fed into a hot water storage tank is heated on, for example, a cheap late-night power to increase a temperature of a fed water and is stored in the storage tank as a hot water.

A typical example of the electric water warmer of this character comprises a hot water tank having a lower bottom portion to which a water feed pipe is connected and an upper top portion to which a water flow-out pipe is connected. One heater is arranged substantially horizontally at a lower portion within the hot water storage tank to heat water fed into the tank to a high temperature. The highly heated water is stored in the storage tank. More concretely, the water fed into the water storage tank and stored therein is heated by current conduction of the heater to gradually increase the temperature of the fed water in a substantially linearly slightly increasing temperature curve as a function of heating time. The thus heated hot water is stored in the hot water storage tank for almost filling in the entire area from the tank lower portion to the tank upper portion.

The electric water warmer of the conventional type described is constructed such that one heater is disposed near the bottom portion of the hot water storage tank, water fed into the hot water storage tank is heated by the heater, and the heated hot water is supplied from the flow-out pipe connected to the top of the hot water storage tank. Therefore, if the hot water is fed in a large amount of volume through the flow-out pipe and so consumed, there may be caused a case where the the hot water in the tank is flown out unexpectedly, or if a current is conducted to the heater after the hot water is left as a residue in the hot water storage tank, the heater comes to heat almost all quantity of the residue within the hot water storage tank, thus a necessary amount of the hot water cannot be secured quickly and a sudden exhaustion thereof cannot be coped with quickly and pertinently.

SUMMARY OF THE INVENTION

An object of the present invention is to eliminate the defects and drawbacks encountered to the prior art described above and to provide an electric water warming system having a simple construction and being capable of effectively obviating exhaustion of hot water in a hot water storage tank and quickly securing hot water of high temperature.

Another object of the present invention is to provide an electric water warming system capable of being effectively alternatively utilized in accordance with a late-night power use and a daytime power use.

These and other objects can be achieved according to the present invention by providing an electric water warming system which comprises a water storage tank of substantially cylindrical to be installed in a vertical fashion, a water feed pipe connected to a bottom portion of the water storage tank for feeding water therein, a hot water flow-out pipe connected to a top portion of the water storage tank for flowing out hot water therefrom, a heating means disposed in the water storage tank at a portion relatively near the bottom portion of the water storage tank, control means operatively connected to the heating means for controlling a temperature of the hot water in the water storage tank, a by-pass pipe connected to a side wall of the water storage tank, and a three-way valve assembled at a portion at which the by-pass pipe and the flow-out pipe are joined, the three-way valve acting so as to select the by-pass pipe and the flow-out pipe in accordance with a state of the hot water in usage thereof.

According to the electric water warming system of the character described above, the by-pass pipe is connected to the side wall of the water storage tank and the three-way valve is assembled in a joint portion of the by-pass pipe and the flow-out pipe connected to the top of the water storage tank. Therefore, the exhaustion of the hot water can be effectively obviated by the selective use of the by-pass pipe and the flow-out pipe by the operation of the three-way valve, and the hot water of high temperature can be quickly coped in the water storage tank of the electric water warming system. Moreover, according to the construction of the electric water warming system, the hot water can be effectively used by the utilization of the late-night power as well as the daytime power.

DESCRIPTION OF THE PREFERRED EMBODIMENTS

One embodiment of an electric water warming system, called merely electric water warmer hereinbelow, according to the present invention will be described hereunder with reference to the accompanying drawings.

Figure 1:
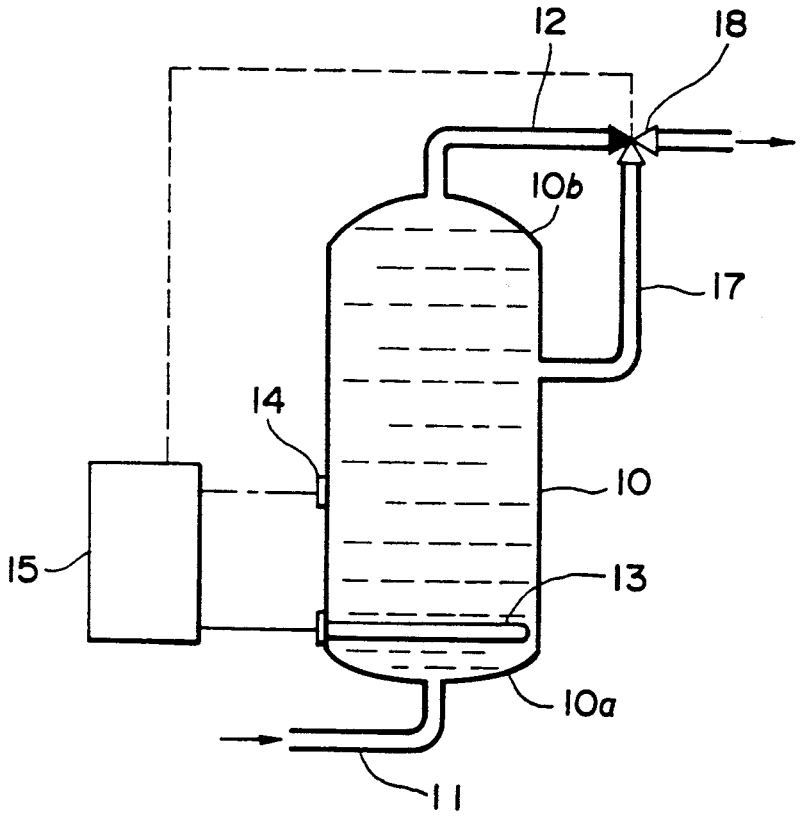
FIG. 1 is an elevational schematic view of one embodiment of an electric water warming system according to the present invention.

Referring to FIG. 1, an electric water warmer is provided with an approximately cylindrical and closed hot water storage tank 10. A feed water pipe 11 is connected to a lower bottom portion 10*a* of the hot water storage tank 10 by means of welding, for example, and a hot water flow-out pipe 12 is also connected to an upper top portion 10*b* of the hot water storage tank 10 by means of welding, for example. The electric water warmer is, for example, a top-stop lifting type equipped with a pressure reducing valve, not shown, assembled with the feed pipe 11 and a faucet, not shown, assembled with the flow-out pipe 12.

A heater 13 is arranged in substantially a horizontal fashion near the bottom portion in the hot water storage tank 10. The heater 13 is mounted on a side wall of the hot water storage tank 13 in, for example, a cantilever fashion. A temperature sensor 14 such as a thermistor or the like for detecting temperature of the fed water or hot water in the storage tank 10 is provided on the tank side wall. An electric signal representing the water temperature detected by the temperature sensor 14 is transmitted to a controller 15 composed of a central processing unit, microcomputor and the like, and a current conducting rate of the heater is controlled by the controller 15. The water fed into the hot water storage tank 10 is heated to a predetermined temperature of about 80° C., for example, by the heater 13.

A by-pass pipe 17 is further connected by means of welding, for example, to the side wall of the storage tank 10 to a portion upward of the temperature sensor 14 and a three-way valve 18 is assembled at a joint portion of the by-pass pipe 17 and the flow-out pipe 12 extending from the upper top portion of the hot water storage tank 10. The three-way valve 18 is controlled by the controller 15, thus alternatively selecting the usage of the flow-out pipe 12 and the by-pass pipe 17.

It is desirable that the hot water storage tank has an inner volume of about 200 l for a family of one or two persons, 300 l for two or three persons, 370 l for four or five persons, and 460 l for five or six persons of HPL-4622 Type of Toshiba Corporation, for example.

An operation of the electric water warmer of the character described above will be taken up for description hereunder.

Figure 2A:
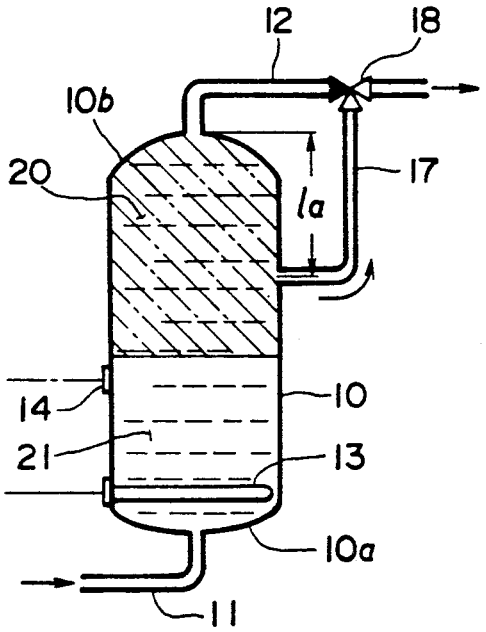
FIGS. 2A to 2D show elevational section of a hot water storage tank of the electric water warming system of FIG. 1 in various states in usage.

It is desired that the electric water warmer operates mainly for preparing a hot water in the hot water storage tank 10 particularly by the utilization of a cheap late-night power other than daytime power. In the electric water warmer, the water fed into the hot water storage tank 10 by way of the water feed pipe 11 is heated to increase the temperature thereof by conducting a current to the heater 13 to a predetermined high temperature of a hot water 20. As shown in FIG. 2A, normally, the three-way valve 18 is operated by the controller 15 or by hands so as to supply the hot water 20 stored in the storage tank 10 by way of the by-pass pipe 17. The supplying of the hot water by way of the by-pass pipe 17 allows the hot water of high temperature to be kept in a domain $l_a$ of the tank upper portion 10*b* all the time.

Figure 2B:
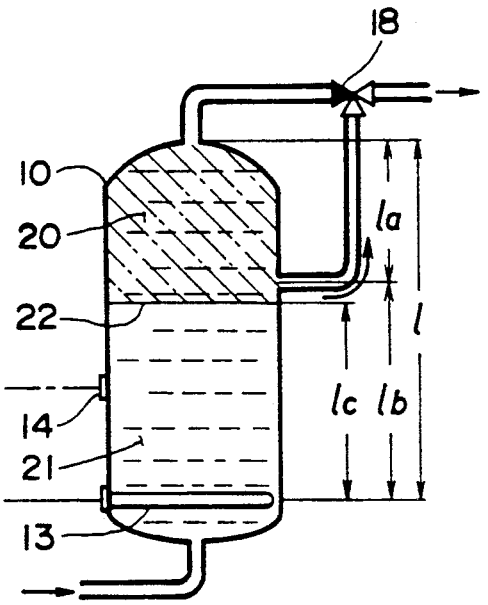
Figure 3:
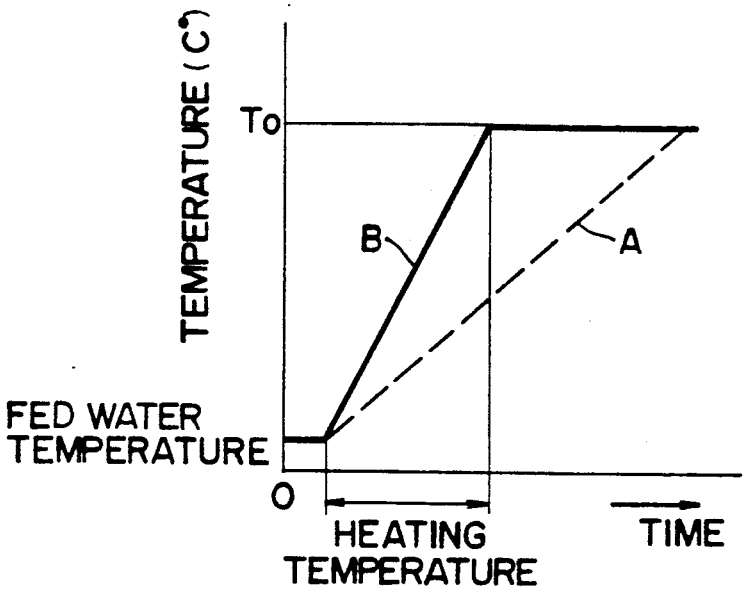
FIG. 3 is a graph representing a temperature rising characteristic curve regarding the electric water warming system of FIG. 1.

When the hot water necessary for bathing, showering, or the like is supplied through the by-pass pipe 17, an interface 22 between the hot waters 20 and 20*a* and a feed water 21 rises in a state shown in FIG. 2B, and the temperature sensor 14 detects a drop of the water temperature. Upon detection of the dropped temperature, the heater is conducted and the feed water in the storage tank 10 is heated up to a predetermined temperature under the control of the controller 15. The heating in this case is applied not to an almost all quantity l in the storage tank 10 but to the water stored in a domain $l_c$ under a domain $l_b$, therefore the temperature of the feed water rises quickly as indicated by a solid line B shown in FIG. 3, which is heated in a short time. A broken line A in FIG. 3 indicates a temperature rise characteristic curve in case of the utilization of the conventional electric water warmer.

Figure 2C:
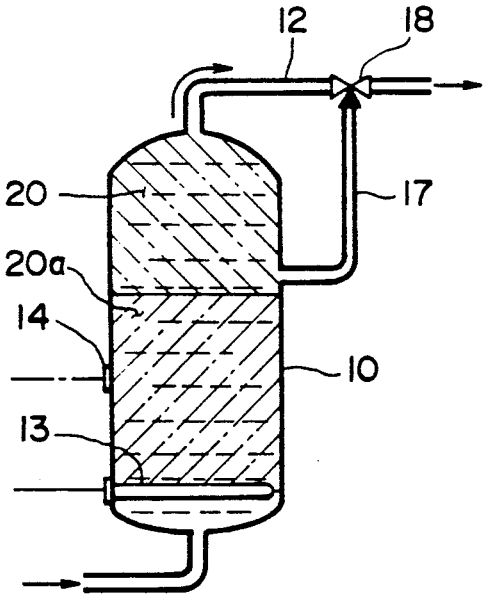

The feed water in the water storage tank 10 is heated by the heater 13 and the completely heated state is shown in FIG. 2C. Thus, any trouble of unexpected exhaustion of the hot water will be substantially eliminated.

Referring to FIG. 2C, the hot waters 20 and 21 storage tank 10 are fed selectively under the control of the three-way valve 18 by way of the flow-out pipe 12. The heater 13 is controlled for daytime operation by the temperature sensor 14 through the controller 15.

As described above, according to the embodiment of the present invention, a water exhaustion phenomenon inherent in the electric water warmer can be effectively prevented by the provision of a very simple construction wherein the by-pass pipe 17 is arranged halfway of the hot water storage tank 10 and the three-way valve 18 is provided at a joint portion of the by-pass pipe 17 and the flow-out pipe 12. The hot water of high temperature can thus be utilized effectively and pertinently.

If the hot water 20 in the storage tank 10 decreases for the feeding through the by-pass pipe 17, heating rate and time of the feed water are minimized and a hot water of high temperature is obtainable quickly by carrying a current to the heater 13, whereby a trouble of unexpected exhaustion of the hot water may be substantially eliminated in case of extracting the hot water in the storage tank 10 in this state through the by-pass pipe 17.

In this case, a top-stop lifting system, for example, is employed for the electric water warmer, and when a faucet of the flow-out pipe 12 is opened, the water is fed into the storage tank 10 through the operation of a pressure reducing valve of the feed pipe and, hence, the hot water in the storage tank 10 is extruded by the pressure of the fed water and fed through the faucet. Accordingly, water same in the quantity as the hot water thus fed is fed into the hot water storage tank 10, and the storage tank 10 is fully filled with the water at all time. Instead of the top-stop lifting system, a source-stop lifting system may be employed for the electric water warmer in an alteration of this embodiment.

Figure 4:
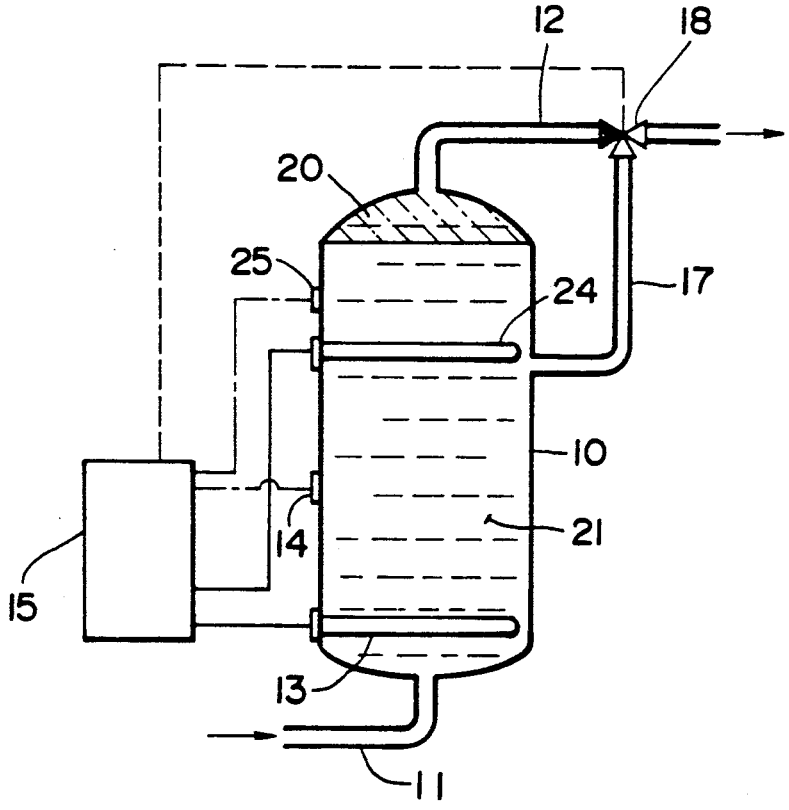
FIG. 4 is an elevational schematic view similar to that shown in FIG. 1 of another embodiment according to this invention.

FIG. 4 represents a modification of the electric water warmer shown in FIG. 1. In this modification, a plurality of heaters, two 13 and 24 in the illustration, are provided in the storage tank 10 with vertical space and a current conduction to the upper heater 24 is also controlled by the controller 15 in response to the temperature detection by an upper sensor 25 arranged above the location of the upper heater 24 in association therewith.

Figure 2D:
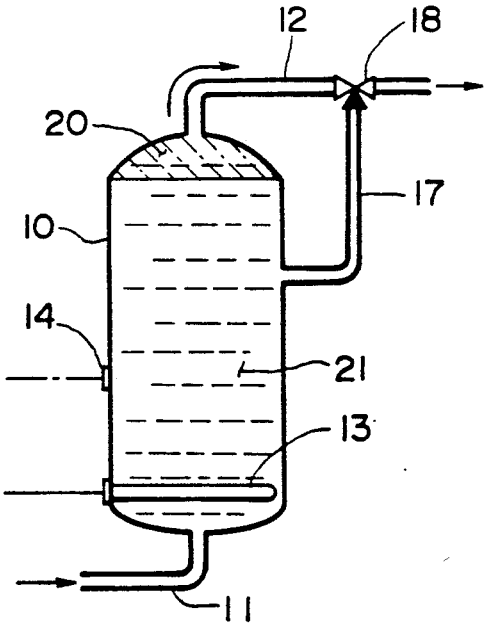

The electric water warmer of this modified embodiment is controlled for operation halfway in substantially the same manner as that in the case of the electric water warmer described with reference to FIGS. 1 and 2. However, as shown in FIG. 2D, when the hot water 20 remains less in the storage tank 10 from feeding through the flow-out pipe 12, a feed water in the hot water storage tank 10 is heated quickly by the upper heater 24, whereby an additional hot water can be secured quickly as required.

In each embodiment according to the present invention, a single or two heaters are arranged for the hot water storage tank 10, but the heater may be provided more than two pieces, as well as the temperature detecting sensor corresponding to the heaters.

It is to be understood by those in the art of this field that the present invention is not limited to the described embodiments and many other changes and modifications may be made without departing the scope of the appended claim.

What is claimed is:

1. An electric water warming system comprising:

a substantially cylindrical water storage tank to be installed in a vertical fashion;

a water feed pipe means connected to a bottom portion of said water storage tank for feeding water thereinto;

a hot water flow-out pipe for flowing out hot water therefrom;

a heating means disposed in said water storage tank at a portion relatively near the bottom portion of the water storage tank, said heating means comprising a plurality of heaters secured to an inside wall of said water storage tank and extending substantially horizontally therefrom in a vertically spaced fashion;

a temperature controlling means including a plurality of temperature sensors disposed correspondingly to said heaters and operatively connected to said heating means for controlling a temperature of the hot water in said water storage tank;

a by-pass pipe means connected to a said wall of said water storage tank; and a three-way valve means assembled at a portion at which said by-pass pipe means and said flow-out pipe means are joined, said three-way valve means acting so as to select one of said by-pass pipe means and said flow-out pipe means in response to a temperature detected by said temperature sensors, such that when the hot water stored in said storage tank at a portion near said by-pass pipe means has a predetermined temperature, the hot water is fed through said by-pass pipe means, and such that when the hot water stored in said storage tank at a portion near said by-pass pipe means drops below the predetermined temperature, the hot water stored at a portion near said flow-out pipe means is fed through said flow-out pipe means.

* * * * *

UNITED STATES PATENT AND TRADEMARK OFFICE

CERTIFICATE OF CORRECTION

PATENT NO. : 5,078,123

DATED : January 7, 1992

INVENTOR(S) : Seiko Nagashima et al.

It is certified that error appears in the above-identified patent and that said Letters Patent is hereby corrected as shown below:

On the title page, in item [21] Appl. No.: change "151,524" to read as --451,524--.

Signed and Sealed this

Fourth Day of May, 1993

*Attest:*

*Attesting Officer*

Michael K. Kirk

MICHAEL K. KIRK

*Acting Commissioner of Patents and Trademarks*